US005427575A

United States Patent [19]

Berk

[11] Patent Number: 5,427,575

[45] Date of Patent: Jun. 27, 1995

[54] TOTEABLE SWINGS

[76] Inventor: Marvin Berk, 41 Union Square W., Suite 1328, New York City, N.Y. 10003

[21] Appl. No.: 93,879

[22] Filed: Jul. 20, 1993

[51] Int. Cl.[6] ..... A63G 9/00

[52] U.S. Cl. ..... 472/118; 297/273; D21/246

[58] Field of Search ..... 472/118, 121, 122, 124, 472/125; 297/273, 281, 183; D21/242, 243, 246, 247; 47/67; 428/328; 182/7

[56] References Cited

U.S. PATENT DOCUMENTS

| | | | |
|---|---|---|---|
| 2,375,087 | 5/1945 | De Bruin | 297/273 |
| 3,323,151 | 6/1967 | Lerman | 297/183 |
| 3,901,165 | 8/1975 | Schlesinger | 248/328 |
| 3,937,463 | 2/1976 | Soisson | 472/118 |
| 5,067,706 | 11/1991 | Tsai | 472/118 |
| 5,238,456 | 8/1993 | Chang | 472/118 |

*Primary Examiner*—Carl D. Friedman
*Assistant Examiner*—Kien Nguyen

[57] ABSTRACT

Toteable swings with a variety of seats designed in characterized form appealing to children come in kits. The swings are highly portable, light weight, and easily carried by children. The swings are designed to be taken along on family outings and can be used where ever there is a suitable tree limb or an appropriate stand. The swing kit includes a designed seat and a nylon rope with a beaded end used for securing the seat and swing and for adjusting swing height for the individual using the swing. Changeable seats are supplied in a variety of flattened characterized seat designs including a frog shape, an airplane designs, a half moon and face shape, a baseball and mit, a flattened friendly elephant, and a mischievous dinosaur. Other designs can be added.

11 Claims, 3 Drawing Sheets

TOTEABLE SWINGS

BACKGROUND OF THE INVENTION

1. Field of the invention

This invention relates to swings in general and is especially directed towards portable swings having changeable seat boards. The present invention incorporates a variety of novelty seat boards into a kit that can be carried along on an outing for use on a convenient tree limb or an available stand.

2. Description of the Prior Art

Many types of swings having a variety of seat boards, ornate and plain, are seen in past art patents. Even so, few are readily available in the market place. A portable swing kit similar to the present invention is neither disclosed as past art nor found for sale in the market place. The present invention with uniquely designed changeable seats seems unique in the field.

SUMMARY OF THE INVENTION

In practicing my invention, I provide a swing kit that is highly portable and can be used wherever there is a suitable tree limb or an appropriate stand. Most recreation areas have one or the other. My swing kit has changeable seats. The seats come in a variety of characterized designs flattened into swing seats. The seats include a smiling frog face design, an airplane design, a half moon with a smiling face design, a baseball and mit design, a flattened friendly elephant face design, and a mischievous dinosaur also flattened into a seat design. These seats are especially attractive to small children but are fun and conversation pieces for adults too. The kit combination lends itself well for exploring many other varieties in uniquely designed seats.

Therefore, a principal object of my invention is to provide highly portable swings in kits with the kits available in a variety of different characterized seat designs.

Another object of the present invention is to provide portable swing kits as toteable swings that can be taken along on a family outing and used with an included rope tossed over a convenient tree limb or a well attached pipe usually available in most any recreational area.

A further object of this invention is to provide a portable swing seat with a rope having an end bead and a slip loop arrangement that allows the seat to be adjusted for high or low swinging and to the individual size of a child or an adult using the swing.

A still further object of the invention is to provide a swing kit that has changeable seats and the changeable seats are formed into novelty shapes of interest to children and fun to use.

Another object of my invention is to provide a portable swing seat with a safety rope, the rope structured of braided nylon with a test rating of 2,000 pounds.

Other objects and the many advantages of the present invention will become understood by reading the numbered parts described in the specification of this application and comparing them with like numbered parts shown in the included drawings.

DESCRIPTION OF THE PREFERRED EMBODIMENTS

Figure 1:
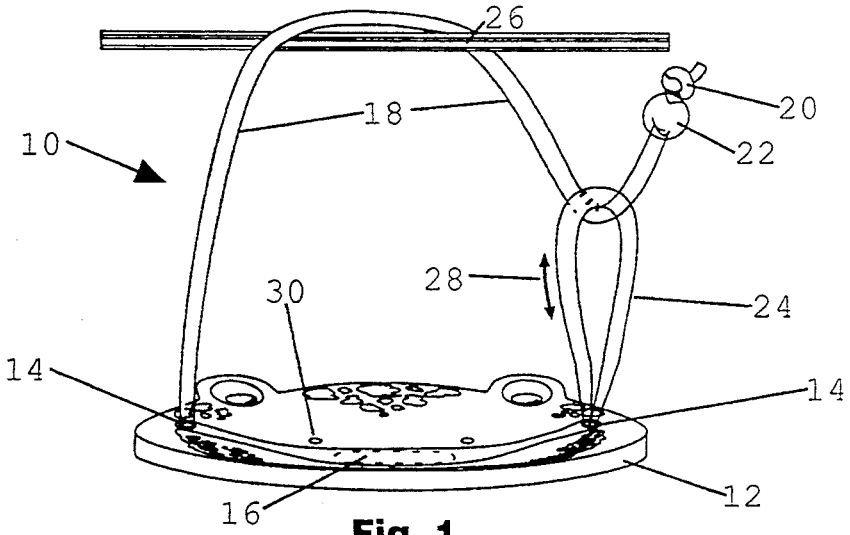
FIG. 1 shows a toteable swing according to the present invention in the form of a flattened frog face swing seat with a nylon rope around a pipe supporting the seat. The seat carrying handle, an aperture in the seat, can be seen in the smiling mouth of the frog face. The bead and loop rope adjusting arrangement pertinent to this invention can be seen right in the illustration on one of the nylon support ropes. As shown, the nylon rope is in a first step of being secured.

Referring now to the drawing figures where toteable swings according to the invention are illustrated having parts numbered correspondingly with described number parts in the following specification. The numeral 10 indicates generally the invention, and at FIG. 1, invention 10 is shown in part with a swing seat 12. Swing seat 12 references all swing seats in general. Swing seats 12 in designed form have a specific number additionally and a name designation. In the FIG. 1 drawing, swing seat 12 has two rope holes 14 in it, one adjacent each end. A nylon rope 18 passes downward as a single line through a first hole 14 and is doubled back upward through a second hole 14 forming an adjustment and tying loop 24. Nylon rope 18 is shown in FIG. 1 after being thrown over a secure support, pipe 26. A first end of nylon rope 18 is under swing seat 12 and not visible in FIG. 1. A second end of nylon rope 18 has a knot 20 and a tying bead 22. Knot 20 and bead 22 double as weight for tossing rope 18 over a handy and substantial pipe stand or a sturdy tree limb and as a tying end for securing nylon rope 18 in adjustment loop 24. Swing seat 12 in the FIG. 1 illustration is a flattened frog face design 30 shown in a top plan view in FIG. 2. Double ended arrow 28 in FIG. 1 indicates how nylon rope 18 can be adjusted up or down according the size of the person who is going to use swing seat 12 and to adjust swing seat 12 a desired swing height before tying.

Figure 2:
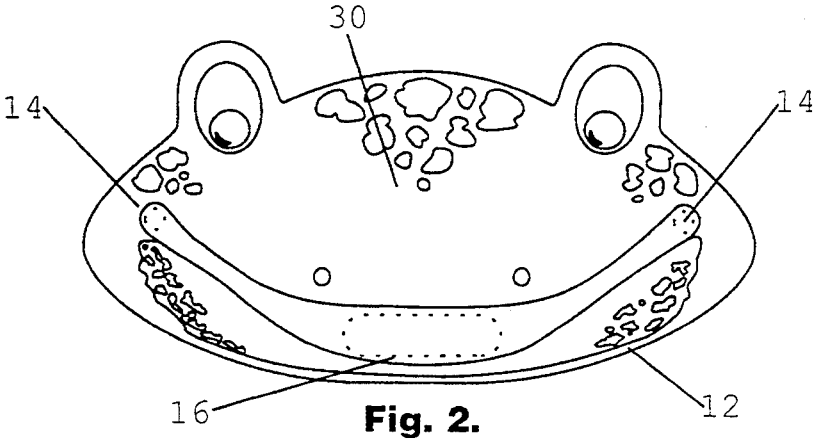
FIG. 2 shows a top plan view of the flattened frog face swing seat according to the invention used in the FIG. 1 illustration. The seat is designed to represent the face of a smiling frog. Each seat is given a "fun" name to identify and designate that particular swing seat. The frog seat shown is designated "Little Leaper."
Figure 3:
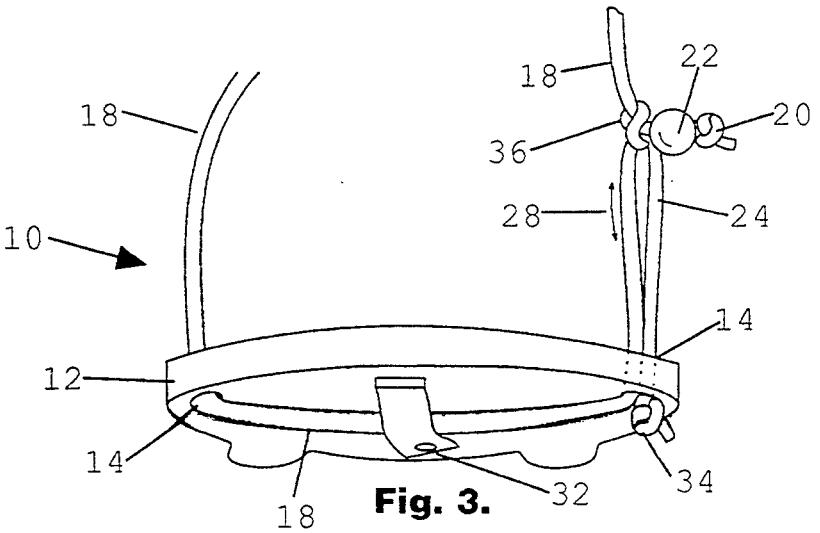
FIG. 3 shows the swing seat and rope of FIG. 1 from the under side of the seat. A rope strap for carrying the seat and rope is shown on the bottom of the seat. The nylon rope shown above the seat is in step two of tying. The swing height has been adjusted with the nylon rope formed into a securing loop knot, retained by the bead and end knot.

To illustrate a designed seat, FIG. 2 shows a top plan view of swing seat 12 in a flattened frog face design 30 designated "Little Leaper," the seat first shown in FIG. 1. As previously stated, besides being numbered, the designed seats described herein are also identified by name designation. In FIG. 2, rope holes 14 can be seen, one at each end of the frog's mouth. Carrying handle aperture 16 is indicated by dotted lines in the lower center of the mouth of frog face design 30. The bottom area of swing seat 12 in frog face design 30 can be seen in FIG. 3. Nylon rope 18 runs down through a first rope hole 14, along the bottom of swing seat 12 passing through carrying rope security strap 32 and loops back up doubled through a second rope hole 14. The lower end of nylon rope 18 is retained by first end knot 34 below swing seat 12 adjacent second rope hole 14. In the FIG. 3 illustration, swing seat 12 has been adjusted to user size and to a desired swing height by increasing and decreasing the length of adjustment loop 24. Double pointer movement arrow 28 indicates the adjustment movement. Nylon rope 18 is tied securely in the selected position by a securing loop knot 36. Bead 22 and knot 20 prevent the end of rope 18 from slipping back through loop knot 36.

Figure 4:
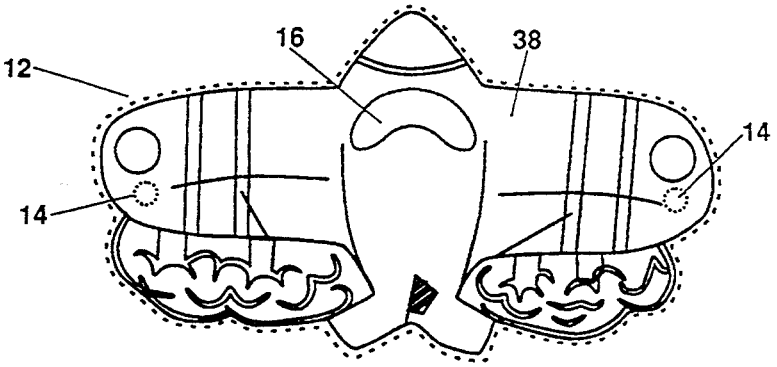
FIG. 4 shows a flattened airplane designed into a swing seat in accordance with the invention. The airplane seat illustration is in a top plan view. The seat shown is designated "Zoomer."

Swing seats of different configurations in accordance with the toteable swings of the present invention are designed as appealing characterizations familiar to children and of interest to adults. The designed seats as shown in FIG. 2 are further illustrated in FIGS. 4, 5, 6, 7, and 8. A particular design of swing seat 12 is referred to by a description, a number, and a designated name, ie: "Swing seat 12 in the FIG. 1 illustration is the seat in the frog face design 30 and is designated "Little Leaper."." A swing seat 12 designated "Zoomer," is shown in an airplane design 38 in FIG. 4. Airplane design 38 has a rope hole 14 adjacent the trailing edge on each wing near the outer end curves. A carrying handle aperture 16 is indicated by dotted lines in the body section towards the front nose end of swing seat 12 in airplane design 38. It is noted that the seats 12 incorporating airplane design 38 and frog face design 30 have rope holes 14 at outer edges so swing seats 12 in these designs are supported on opposite sides of the user for swinging.

Figure 5:
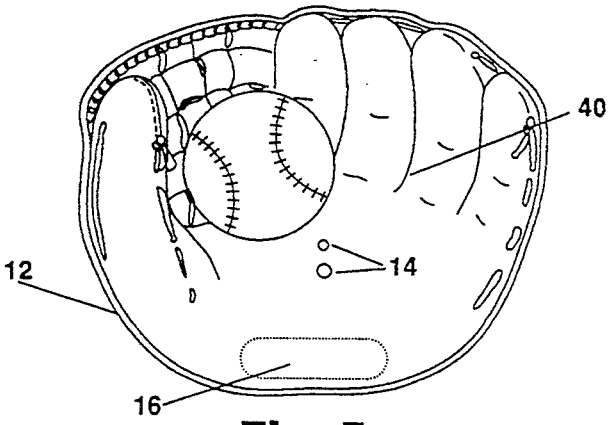
FIG. 5 shows a swing seat according to the invention designated "Big Leaguer." The flattened seat design is shown in a top plan view.
Figure 6:
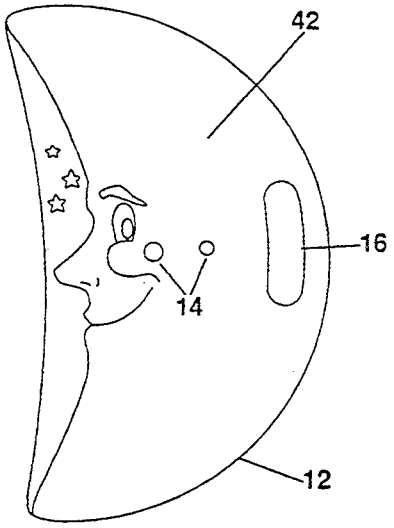
FIG. 6 shows a top plan view of a swing seat particular to the present invention designated "Moonbeamer."
Figure 7:
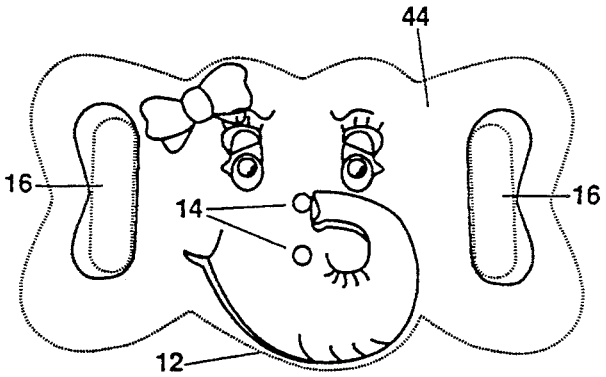
FIG. 7 shows a top plan view of a swing seat pertinent to the invention shaped like a flattened elephant head. The seat shown is designated "Ella Elephant."
Figure 8:
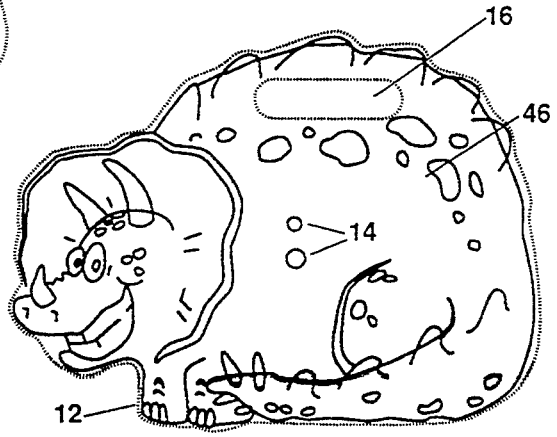
FIG. 8 is a swing seat according to this invention designated "Duffy Dinosaur." The seat has the shape of a dinosaur flatter into a swing seat and is shown in a top plan view.

In FIG. 5, a swing seat 12 according to the invention designated "Big Leaguer" is shown in a base ball and mitt design 40. Base ball and mitt design 40 is a swing seat 12 with rope holes 14 aligned adjacently in the center. The user straddles a double line of nylon rope 18 in a center position (shown in FIG. 13) when using this type of seat. The seat illustrations that follow are all center support seats. A carrying handle aperture 16, common to all designed seats, is in the lower section of base ball and mitt design 40 as shown in FIG. 5. Other seats provided in accordance with the invention in designs considered of interest to children include: FIG. 6, a swing seat 12 having a smiling face in a half-moon design 42, designated "Moonbeamer;" a swing seat 12 in FIG. 7 shaped into an elephant head design 44, designated "Ella Elephant;" a swing seat 12 according to this invention designated "Duffy Dinosaur" shown as a dinosaur design 46 in FIG. 8. Drawing figure views of swing seats 12 in FIG. 2 and FIGS. 4–8 are all shown in top plan views and common to the designed seats are the rope holes 14 and the carrying handle apertures 16 positioned as shown in the various views.

Figure 9:
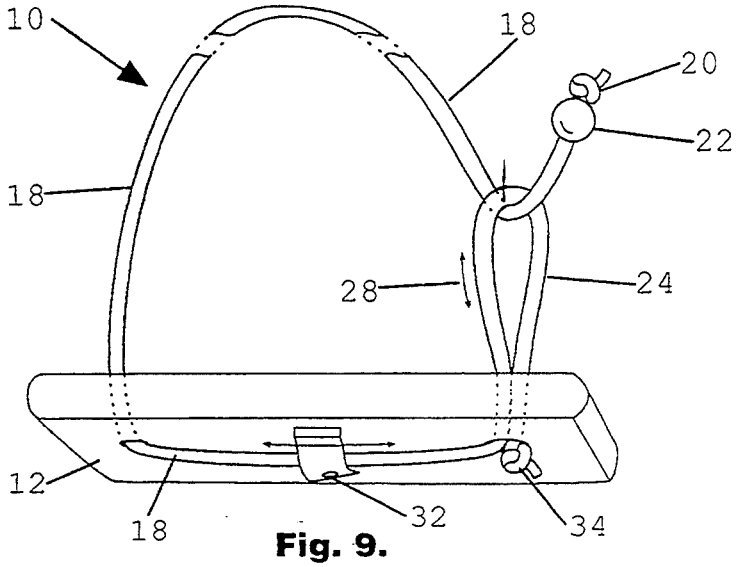
FIG. 9 further illustrates the nylon rope adjustment arrangement particular to this invention. The drawing shows the bead-knot end of the rope slipped through a loop above a plain swing board seat. The rope is ready for adjusting the rope length and tying the rope securely. The seat board is shown from the under side revealing how the rope extends under the seat, loops up through an end rope hole to form the adjustment loop, and is secured by a first end knot under the seat. The rope securing and carrying strap can be seen affixed just below a carrying handle aperture in the seat. In this drawing, the rope is ready for swing height adjustment and tying.
Figure 10:
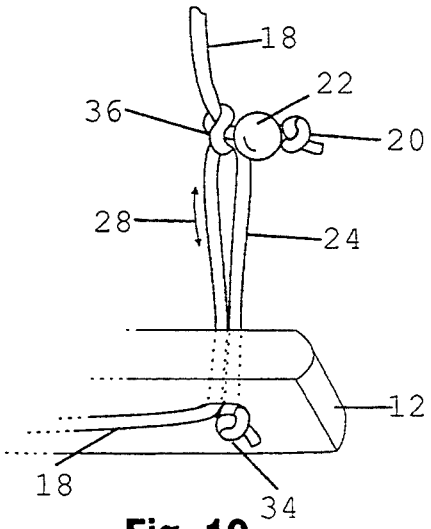
FIG. 10 is a sectional view of the FIG. 9 swing seat. This shows how the bead-knot end of the rope is tied after the swing seat has been adjusted for swing height.

In FIG. 9, nylon rope 18 pertinent to the invention and important to the safety of a child or an older person using swing invention 10 is shown mounted on a plain swing seat 12. Nylon rope 18 is a safety rope structured of braided nylon with a test rating of at least 2,000 pounds. As shown in the FIG. 9 illustration, nylon rope 18 has a knot 34 affixed at a first terminal end under swing seat 12 at a second rope hole 14. Nylon rope 18 is doubled and looped up through rope hole 14 and formed into an adjustment loop 24. Knot 34 secures a first terminal end of nylon rope 18 to the underside of plain swing seat 12. After being looped above swing seat 12, the free second terminal end of nylon rope 18 that passes back down through second rope hole 14, runs along the bottom side of swing seat 12 above rope carrying security strap 32, runs back up through first rope hole 14, and is free to be thrown over an available swing support, ie: a pipe stand 26, FIG. 1, or a sturdy tree limb 50, FIG. 13. After securing nylon rope 18 to the swing support, the second terminal end of nylon rope 18 affixed with bead 22 and knot 20 is passed through adjustment and tying loop 24. To adjust swing seat 12 to a desired height, loop 24 can be lengthened or shortened in accordance with directional arrow 28 to be suitable for the person going to use the swing. After adjustment, nylon rope 18 is tied into a securing knot 36 and the toteable swing of this set of invention 10 is ready for use. The adjustment arrangements of nylon rope 18 shown in FIGS. 1 and 3 is common to all swing seats 12, plain and in designed form, and to all seats 12 having nylon rope 18 centrally attached and to seats 12 having rope holes 14 adjacent outer edges. FIG. 10, in a sectional view of the FIG. 9 swing seat 12, further illustrates how bead 22 and knot 20 at the end of nylon rope 18 is tied after swing seat 12 has been adjusted for the person going to use it and for swing height.

Figure 11:
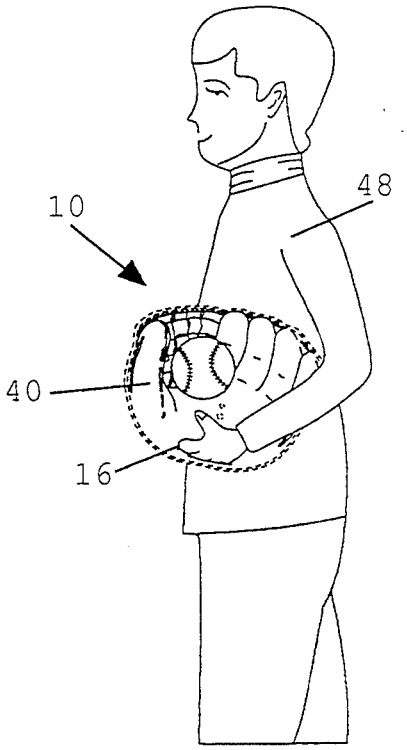
FIG. 11 shows a youngster carrying a toteable swing seat according to the invention. The seat being carried is designated "Little Leaguer" and is light weight enough that a small child can easily transport it with attached rope by holding the seat at the specially apertured hand holds as the youth in the illustration is doing. The apertured handle shown is common to all the seats of this invention.

A youth 48 is shogun carrying a swing seat 12 of baseball and mitt design 40 according to this invention in FIG. 11. Youth 48 is carrying the seat designated "Little Leaguer," and is holding it by apertured handle 16. All swing seats 12 in the toteable swings of this invention are light weight and have apertured handles 16 so even a small child can easily transport a swing seat 12 with a nylon rope 18 attached by rope securing strap 32.

Figure 12:
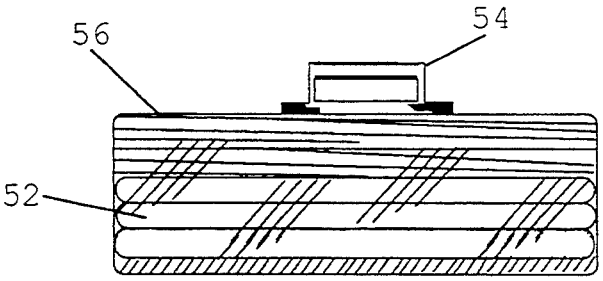
FIG. 12 shows an expandable plastic carrying case useful for transporting and storing one or more toteable swings illustrated in accordance with this invention.

An expandable plastic carrying case 52 useful for transporting and storing one or more swing sets of invention 10 is shown in FIG. 12. A handle 54 is affixed to the top of case 52 to one side of a zipper lock 56 running full length along the top side of case 52.

Figure 13:
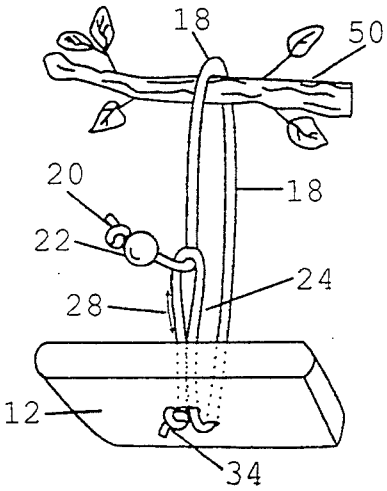
FIG. 13 illustrates a swing seat with the nylon rope fastened through the swing seat in a center position. The rope has been tossed over a convenient tree limb and is ready for swing height adjustment and securing by a second tying. As can be seen from the illustrations, seats shown in FIGS. 5–8 are designed for the nylon rope to be attached in a center position.

In FIG. 13, a swing seat 12 with nylon rope 18 fastened through rope holes 14 in a center position is illustrated. As shown, nylon rope 18 has been tossed over a convenient tree limb 50 and is ready for swing height adjustment to be made at adjustment loop 24, then secured by a second tying loop 36 as shown in FIG. 10. As seats shown in FIGS. 5–8 are designed for nylon rope 18 to be attached in a center position, FIG. 13 illustrates this application. In addition to the strength rating of nylon rope 18, as an increased safety factor, all swing seats 12, designed and plain, are all-weather coated with high-endurance paints to prevent splinters and water seepage.

Although I have described embodiments of my toteable swings invention with considerable detail in the foregoing specification and have illustrated them extensively in the drawings, it is to be understood that I may practice variations in the invention which do not exceed the scope of the appended claims. Also, any variations of my invention practiced by others which fall within the scope of my claims, I shall consider to be my invention.

What is claimed is:

1. Toteable swings comprising:

(a) at least one swing seat;

said swing seat changeable to accommodate selected characterized seat forms;

(b) at least one rope having a head, said rope of sufficient length for attachment to an overhead supporting member and to said swing seat in at least one position in a manner to produce a swinging seat supportive of and useful to human beings;

(c) means attaching said rope to said swing seat;

(d) means for adjusting said swing seat to a particular height relative to a selected area under said swing seat;

(e) mean providing safety factors incorporated in said swings;

(f) means providing for hand holding said swing seat during portage;

(g) means for temporary attachment of rope to said swing seat;

said means for adjusting said swing seat to a particular height relative to a selected area under said swing seat includes a loop arranged in said rope to slide upwards and downwards in said attaching means to a selected position, to be tied at the selected position by a free end of said rope passed through said loop, knotted and retained by said bead and said knotted free end of said rope and by pressure on the full length of said rope during swing use.

2. The toteable swings of claim 1 wherein said means attaching said rope to said swing seat includes rope holes in said swing seat with said rope passed therethrough and said rope enlarged on an emergent side preventing reverse withdrawal therefrom.

3. The toteable swings of claim 1 wherein said means providing safety factors incorporated in said swing kits includes said rope being of nylon structure with a test rating of at lease a 2,000 pound pull-to-break factor, said swing seats all-weather coated and sealed with high endurance paints to prevent splinters and water seepage.

4. The toteable swings of claim 1 wherein said means providing for hand holding said swing seat during portage includes hand-sized elongated apertures cut through said swing seats as hand grips for carrying said swing seats.

5. The toteable swings of claim 1 wherein said means for said attachment of rope to said swing seat includes a rope securing strap on the underside of said swing seat, said rope securing strap having a releasable end.

6. The toteable swings of claim 1 wherein said swing seat changeable to accommodate selected characterized seat forms, said characterized seat forms including: a swing seat designed as a flattened frog face in the specifications.

7. The toteable swings of claim 1 wherein said swing seat changeable to accommodate selected characterized seat forms, said characterized seat forms including: a swing seat designed as a flattened airplane design.

8. The toteable swings of claim 1 wherein said swing seat changeable to accommodate selected characterized seat forms, said characterized seat forms including: a swing seat designed as a flattened base ball and mitt.

9. The toteable swings of claim 1 wherein said swing seat changeable to accommodate selected characterized seat forms, said characterized seat forms including: a swing seat designed as a flattened smiling half-moon face.

10. The toteable swings of claim 1 wherein said swing seat changeable to accommodate selected characterized seat forms, said characterized seat forms including: a swing seat designed as a flattened elephant head.

11. The toteable swings of claim 1 wherein said swing seat changeable to accommodate selected characterized seat forms, said characterized seat forms including: a swing seat designed as a flattened a dinosaur.

* * * * *